US011421361B2

(12) United States Patent
Latendorf et al.

(10) Patent No.: US 11,421,361 B2
(45) Date of Patent: Aug. 23, 2022

(54) DEVICE FOR THE PRODUCTION OF NONWOVEN FABRIC WEBS AND METHOD FOR INSTALLING SUCH A DEVICE

(71) Applicant: ANDRITZ KUESTERS GMBH, Krefeld (DE)

(72) Inventors: Dennis Latendorf, Krefeld (DE); Robin Stephane, Duesseldorf (DE); Tomas Noelle, Dresden (DE)

(73) Assignee: ANDRITZ KUESTERS GMBH, Krefeld (DE)

( * ) Notice: Subject to any disclaimer, the term of this patent is extended or adjusted under 35 U.S.C. 154(b) by 446 days.

(21) Appl. No.: 16/519,005

(22) Filed: Jul. 23, 2019

(65) Prior Publication Data

US 2020/0032436 A1 Jan. 30, 2020

(30) Foreign Application Priority Data

Jul. 26, 2018 (DE) ..... 10 2018 118 095.0

(51) Int. Cl.

| | |
|---|---|
| ***D21F 9/00*** | (2006.01) |
| ***D04H 1/736*** | (2012.01) |
| ***D21F 7/00*** | (2006.01) |
| ***D21G 9/00*** | (2006.01) |

(52) U.S. Cl.

CPC ..... *D04H 1/736* (2013.01); *D21F 7/00* (2013.01); *D21F 9/00* (2013.01); *D21G 9/00* (2013.01)

(58) Field of Classification Search

CPC .. D21F 9/00; D21F 7/00; D04H 1/736; D21G 9/00; D21G 5/00

USPC ..... 162/232

See application file for complete search history.

(56) References Cited

U.S. PATENT DOCUMENTS

| | | | | |
|---|---|---|---|---|
| 2009/0301678 | A1 | 12/2009 | Videgren | |
| 2016/0167724 | A1* | 6/2016 | Kilibarda | B23K 11/115 29/401.1 |
| 2019/0084899 | A1* | 3/2019 | Loyola Irribarra | C06B 21/0091 |

FOREIGN PATENT DOCUMENTS

| | | |
|---|---|---|
| EP | 2 735 647 A1 | 5/2014 |
| FI | 124143 B | 3/2014 |
| WO | WO 2008/018819 A1 | 2/2008 |

* cited by examiner

*Primary Examiner* — Mark Halpern
(74) *Attorney, Agent, or Firm* — Norman B. Thot

(57) ABSTRACT

A device for the production of nonwoven fabric webs. The device includes a nonwoven production device comprising a supporting structure, and an auxiliary unit comprising at least one liquid tank and a platform arranged on a top side of the auxiliary unit. The nonwoven production device is arranged on the supporting structure in an assembled state. The nonwoven production device and the auxiliary unit are arranged in relation to each other so that, for at least one of assembling, operating, and repairing the nonwoven production device, access to the nonwoven production device is provided from the platform.

12 Claims, 4 Drawing Sheets

DEVICE FOR THE PRODUCTION OF NONWOVEN FABRIC WEBS AND METHOD FOR INSTALLING SUCH A DEVICE

CROSS REFERENCE TO PRIOR APPLICATIONS

Priority is claimed to German Patent Application No. DE 10 2018 118 095.0, filed Jul. 26, 2018. The entire disclosure of said application is incorporated by reference herein.

FIELD

The present invention relates to a device, which is also called a system, for the production of nonwoven fabric webs, in particular in accordance with the wetlaid nonwoven process, having a nonwoven production device in the assembled state situated on a supporting structure, in particular on the top side of the supporting structure, and an auxiliary unit having at least one liquid tank. The present invention furthermore relates to a method for installing such a device.

BACKGROUND

Such devices, also called fiber fleece machines, wet forming systems, or systems for the production of wetlaid nonwovens, are known in multiple configurations and mostly form a section of a production or manufacturing line subdivided into a plurality of sections. Such devices can be constructed connectedly as a unit or modularly and/or modularly-like. Regarding the last mentioned design, the device in particular includes modules or component groups which can be joined together for forming the device, which can be exchanged or replaced independently from one another and/or which can, for example, be pre-installed as a unit by the manufacturer, be delivered to a client, and there merely be assembled as a final product. In the present case, the nonwoven production device including, for example, its supporting structure, can be understood as a first module and the auxiliary unit featuring at least the liquid tank can be understood as a second module of the device. The supporting structure can in particular be used as a base or an elevation for the nonwoven production device. It should be made clear that, in the present case, the assembled state refers to a state suitable for operating the device, i.e., to produce a nonwoven fabric web. Alternatively, to the assembled state, the device can optionally be moved into a presently referred to transport state, which is suitable to transport or store the device or individual modules. It should also be noted that the subsequently used expression "in or within the supporting structure" is always to be understood as being in or within a space surrounding the supporting structure, but is not to be understood in the sense of being in or within the material or raw material of the supporting structure.

In wetlaid nonwoven production, nonwoven fibers are introduced into a fluid medium or into a liquid, for example, water, are uniformly distributed in the liquid and, by discharging the liquid at a forming screen, are collected for forming a homogeneous fiber nonwoven layer. The nonwoven production device typically includes a liquid spraying or liquid distributing device for uniformly distributing the liquid, which liquid includes fibers and which is supplied to the nonwoven production device, and a screen, also called a forming screen, such as an inclined screen or screen belt, for separating, in particular draining, the liquid from the fibers.

The liquid is thereby collected in the nonwoven production device primarily below the screen and is then, for example, resupplied to the liquid tank. The nonwoven production device may be fluidically connected to the liquid tank therefor. The fiber fleece deposited at the forming screen of the nonwoven production device is subsequently removed or forwarded by the screen, and it is, for example, passed on to the next machine or production line for further processing. This process is mostly continuous. The forming screen can, for example, be configured in an endless manner for this purpose, for example, as a circumferential screen belt, and the manufacture of the circumferential screen belt is carried out with or without forming a weld.

For draining the liquid penetrating the screen, the geodetic height difference between the liquid level in the screen region, in particular in a drainage tank located below the screen, and a water level present in the liquid tank is typically used. The liquid tank is typically situated lower than the screen therefor. To avoid a construction height which is too high, such devices in practice are typically situated on two levels or floors, for example, on the floor of a production hall and of a basement located thereunder. Such devices therefore regularly require specific structurally engineered conditions and are relatively space-consuming. Such devices are also generally built as stationary systems, which are firmly installed for period of time which is as long as possible.

The liquid collected in the liquid tank can be re-fed via a pipe system, in particular a short circulation situated on the inlet side, via a pump to the nonwoven production device. An excess portion of the liquid can in particular be re-fed into a stock preparation, in particular a fiber preparation system for the wetlaid process, and be re-used to prepare the fibers.

All components and component groups of the device, such as the nonwoven production device, the actuators of the device, and the liquid tank, are typically situated interconnectedly as a unit or as a component group in a delimited area defined by the production line. To avoid that the work processes of the machines are negatively impacted or that access to at least some system parts is hampered, the actuators and connecting pipes are thereby for the most part situated in a side area of the nonwoven production device, in particular at a so-called driving side typically situated opposite a so-called operator side, from which the nonwoven production device is accessible for operation and service.

On account of the size and complexity of such devices, the individual components, for example, the nonwoven production device, are often pre-assembled by the manufacturer, at least partially again disassembled for transport, and fully installed at the device or system at the final destination of operation. A previously-described device in WO 2008/018819 A1 is configured so that it is fully assembled by the manufacturer and is inserted as a whole into a transportation container and, with the aid of the transportation container, can be transported to a final destination of operation.

A disadvantage thereof is, however, that, in particular when operating the device, the compact design limits access to individual, in particular to service-intensive, components of the nonwoven production device, for example, the forming screen or the device for draining the liquid from the forming screen.

SUMMARY

An aspect of the present invention is to provide a device for the production of nonwoven fabric webs which improves on at least one of the disadvantages mentioned above, and which, in particular when in an operating state, is constructed in a space-saving and operator-friendly manner, and which is quickly and cost-effectively assembled and disassembled for transportation.

In an embodiment, the present invention provides a device for the production of nonwoven fabric webs. The device includes a nonwoven production device comprising a supporting structure, and an auxiliary unit comprising at least one liquid tank and a platform arranged on a top side of the auxiliary unit. The nonwoven production device is arranged on the supporting structure in an assembled state. The nonwoven production device and the auxiliary unit are arranged in relation to each other so that, for at least one of assembling, operating, and repairing the nonwoven production device, access to the nonwoven production device is provided from the platform.

BRIEF DESCRIPTION OF THE DRAWINGS

The present invention is described in greater detail below on the basis of embodiments and of the drawings in which.

DETAILED DESCRIPTION

Figure 1:
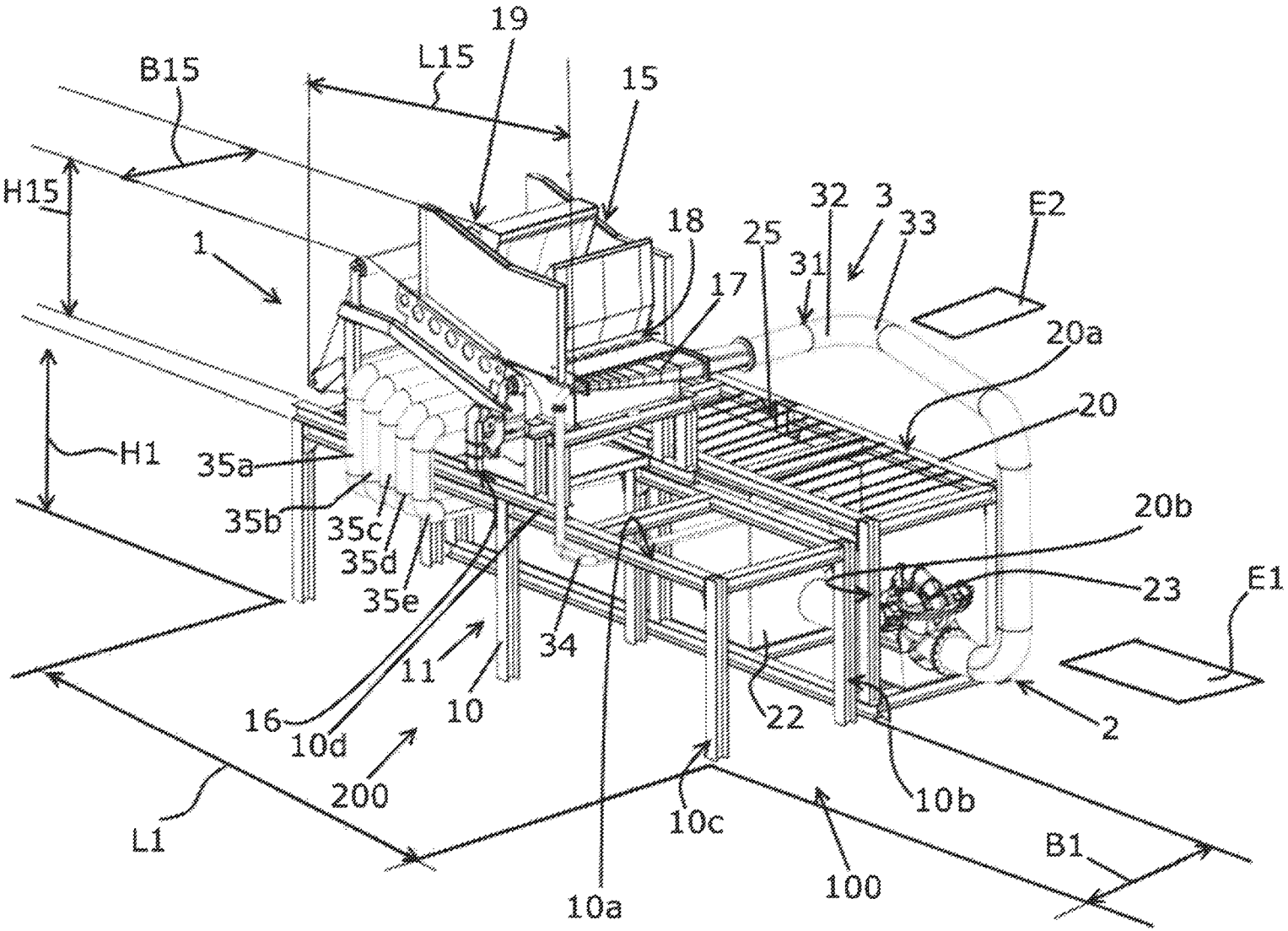
FIG. 1 shows an embodiment of the device according to the present invention in the assembled state in a perspective view.

The present invention provides that the auxiliary unit on a top side has a platform, and the nonwoven production device and the auxiliary unit are situated in relation to each other so that access to the nonwoven production device is provided from the platform for installing, operating and/or repairing the nonwoven production device. In so doing, a work platform, in particular for directly operating the nonwoven production device in a machine-oriented manner, can be provided at a topside of the auxiliary unit. For this purpose, the platform, also called a work platform, can, for example, be situated at least at the same construction height as the nonwoven production device. The platform can, for example, be formed by the entire area of the top side of the auxiliary unit. For providing a relatively comfortable access to the platform and a secure freedom of movement of a person present on the platform, in an advantageous embodiment, support and safety devices can, for example, be provided at the auxiliary unit, for example, a staircase, a ladder, and/or a safety barrier, for example, a guardrail. In so doing, a person can reach the platform in a relatively easy and safe manner and safely move around on the platform. The support and safety devices can, for example, be removed from the auxiliary unit in a relatively easy manner and, for a transport state, can be stored within the auxiliary unit. In the present case, the auxiliary unit is in particular to be understood as a separately formed component group or module of the device which can, for example, be formed by the liquid tank and the frame structure.

In the assembled state, the auxiliary unit can, for example, be situated directly or indirectly next to the supporting structure of the nonwoven production device, and is in particular situated adjacent at the side. In so doing, the nonwoven production device present on the supporting structure can be integrated into a production line, while the auxiliary unit can be situated adjacent at the side or next to the production line. Access to the nonwoven production device from the side is thereby advantageously enabled. In an embodiment, the auxiliary unit can, for example, be situated adjacent at a longitudinal side of the supporting structure, in particular by a longitudinal side so that the auxiliary unit and the supporting structure in their respective longitudinal extension are situated substantially parallel to each other. In an embodiment, the auxiliary unit situated parallel to the supporting structure can, for example, extend over the complete length of the supporting structure and/or the nonwoven production device. In so doing, with the aid of the auxiliary unit situated adjacent to the supporting structure, a work place, which provides access to all parts situated in the production direction, is machine-oriented, relatively generously sized, and, in particular, is not affected by the nonwoven production device and is provided for one or a plurality of persons for installing, operating, or servicing the nonwoven production device.

In an embodiment, the auxiliary unit and the supporting structure in the assembled state can, for example, be mounted or situated in the same plane, for example, a same horizontal plane, in particular at the same floor level. A positioning of the individual modules of the device on a floor-to-floor basis can thereby in particular be avoided and the device can in total in particular be mounted on the same level or production hall floor. This is particularly advantageous for (mostly customer) facilities or properties which have no additional floors. It should be clear that the term "same plane" or "same geodetic height" is to be understood as a same floor level or same ground level, but not as two planes corresponding precisely to the millimeter. Vertical deviations between the auxiliary unit and the supporting structure, for example, resulting from unevenness in the floors, inclined floors, or other conditions of, for example, +/−1 m, are also included in the term "same plane." The auxiliary unit and the supporting structure, in particular at their lay-on points, can have maximum vertical deviations from each other of up to +/−0.5 m, for example, up to +/−0.1 m.

In an embodiment, the top side of the auxiliary unit and the bottom side of the nonwoven production device can, for example, be situated in a same plane, for example, a same horizontal plane, in particular at a substantially equal geodetic level. An advantageous access from the side to, for example, all components of the nonwoven production device situated at a top side or on top of the supporting structure is thereby enabled, for example, also to components situated far on the bottom of the nonwoven production device. The term "same plane" or "same geodetic height" is again to be understood as the same floor level or the same ground level, but not as two planes corresponding precisely to the millimeter. Vertical deviations can here also be in the range of up to +/−1 m, for example, of up to +/−0.5 m, for example, of up to +/−0.1 m.

In general, for operating, assembling, and/or servicing the nonwoven production device, the platform situated at the top side of the auxiliary unit can at least in areas and/or at least temporarily have a floor level which is elevated vis-à-vis the bottom side of the nonwoven production device and/or the top side of the auxiliary unit. Access to the nonwoven production device, for example, for handling or controlling parts situated in particular far on the top of the nonwoven production device, can thereby be improved for a person.

In an embodiment, the supporting structure and the auxiliary unit can, for example, be formed equal in height, or, expressed differently, to have the same height. The supporting structure and the auxiliary unit can thereby be situated on an even ground, and the platform and the bottom side of the nonwoven production device can be situated at an equal height, in particular in the same plane.

The supporting structure and the auxiliary unit can, for example, additionally also have the same width and the same length. The required space for respectively positioning the system and the auxiliary unit is thereby defined in a particularly easy manner and, for example, when planning the production line, is able to be illustrated and implemented in a particularly easy way. The supporting structure and the auxiliary unit can, for example, respectively have an outer dimension having a maximum length of 16 m, a maximum width of 2.5 m, and a maximum height of 2.7 m. As a result, the supporting structure and the auxiliary unit can, for example, fit into a standard transport container and in this configuration be transported in a particularly easy way. The length of the supporting structure and/or the auxiliary unit can, for example, be 13.5 m, for example, 5.9 m, for example, 12 m, respectively. The width of the supporting structure and/or the auxiliary unit can, for example, be 2.4 m, for example, 2.35 m, respectively. The height of the supporting structure and/or the auxiliary unit can, for example, be 2.4 m, respectively. The supporting structure and the auxiliary unit can (in particular as a function of the size of the nonwoven production device) respectively be configured to be significantly smaller.

In the assembled state, a part of the nonwoven production device can, for example, be movable in the direction of the auxiliary unit, in particular in the area above the auxiliary unit. The complete nonwoven production device or only a part of the nonwoven production device can thereby be moved, for example, for the purpose of servicing or replacing, from a position located above the supporting structure, for example, sideways out of the production line in the direction of or above the auxiliary unit. An assembly and/or servicing of the device can thereby be carried out in a particularly easy manner. Furthermore, in so doing, for example, when starting up operation, a web of fabric can be inserted in a user-friendly manner along a predetermined course into a specific path or area. It can, for example, be provided that a screen belt unit or a screen belt frame for the purpose of controlling or exchanging the screen belt can be moved in the direction of the platform. For this purpose, at least one suitable guide arrangement can, for example, be provided, for example, a guide rail, on which the nonwoven production device or a part of the nonwoven production device can be moveably mounted.

The supporting structure and the auxiliary unit can, for example, be mechanically connectable to each other. A particularly stable base for the device can thereby be provided. The connection can, for example, be carried out by a releasable coupling device, for example, by forming a positive connection, for example, at abutting corners of the supporting structure and auxiliary unit.

The auxiliary unit can, for example, have a frame structure which at least surrounds the liquid tank. The side walls of the liquid tank can thereby be supported by the frame structure, in particular on the side over the entire height. A space-saving device can also in particular be provided. The frame structure and also the supporting structure can, for example, be formed by a plurality of stilts and longitudinal and transverse carriers. The supporting structure and/or the frame structure can, as a result, serve as a safety, standing or supporting rack, in particular for setting up the device, in particular for making a foundation, storing, moving or displacing. In an alternative embodiment, the frame structure can, for example, be formed at least in part by the liquid tank. The side walls of the liquid tank can in particular replace at least individual struts and carriers of the frame structure so that a particularly compact device can be provided.

The frame structure can also form a suitable base for the liquid tank, which in the assembled state and during operation is relatively heavy, so that a stable base for the liquid tank can be provided, in particular when substrate conditions, for example, gravel or sand soil, are unknown. In this instance, the liquid tank can, for example, take up approximately two thirds of a space surrounded or spanned by the frame structure. An additional pump for transporting fluid stored in the liquid tank can, for example, be situated within the space surrounded by the frame structure.

In the assembled state, a fluidic connection can, for example, be provided between the nonwoven production device and the liquid tank with the aid of at least one pipe system, the pipe system including at least one pipe, which at least on one side is guided in and/or through the supporting structure and/or the auxiliary unit. It is thereby in particular provided that, on the side of the nonwoven production device facing the platform, particularly free access as unrestricted as possible to the nonwoven production device is provided. The pipes can thereby serve to supply or discharge the liquid, the supply line being understood as a pipe having a fluid flowing in the direction of the nonwoven production device and the discharge line being understood as a pipe having a fluid flowing away from the nonwoven production device.

A first pipe, serving as a supply line from the liquid tank to the nonwoven production device, in particular to a manifold of the nonwoven production device, at the auxiliary unit at the end face can, for example, be guided out of the space surrounded by the auxiliary unit, be guided upward and then partially above the auxiliary unit, and finally be guided sideways into the nonwoven production device. In an area above the auxiliary unit, a section of the pipe is thereby situated which is accessible in a relatively easy way for a person located on the platform. This can, for example, be advantageous for installation, for a visual inspection of the fluid, or for disposing an additional intermediate tank, such as a mixer.

A fluid cycle, formed by the previously mentioned first pipe serving as a supply line and an additional second pipe serving as a discharge line, can also be provided between the nonwoven production device, in particular the manifold, and a headbox pump. This fluid cycle can be situated at the nonwoven production device in particular on the side of the supply line and, for this reason, is also referred to as supply-side fluid cycle.

The supply-side fluid cycle can, for example, be connected at the headbox pump which transports the liquid, mostly water, provided in the liquid tank, together with a fiber material uniformly upward to the nonwoven production device. A further liquid cycle, in particular the main liquid cycle, can be formed by the first pipe mentioned previously and at least one pipe connecting the nonwoven production device to the liquid tank and serving as a discharge line.

In an embodiment, at least the pipe serving as a discharge line, can, for example, be guided at least by a section below the nonwoven production device from a first side of the supporting structure through the supporting structure to a second side of the supporting structure, in particular lying opposite the first side wall. The second side of the supporting structure can in particular be the side which is facing the auxiliary unit. The pipe in this case which can, for example, be formed in a substantially C-shaped manner, is connected by a top connector to the nonwoven production device, in particular to a manifold flow spreader, is guided into a substantially vertical area downward and, in a bottom area, is guided substantially by a slight incline in a specified flow direction through the supporting structure up to the auxiliary unit and is there, for example, connected to the pipe section running into the fluid tank. It is thereby in particular provided that on the side of the nonwoven production device facing the platform, particularly free access to the nonwoven production device is provided as unrestricted as possible.

In the transport state, the nonwoven production device can, for example, be surrounded by the supporting structure. In the transport state, the nonwoven production device can in particular be disposed as a whole within the supporting structure, i.e., within the space spanned by the supporting structure as set forth above. At least in the transport state, the liquid tank, the liquid feeding pump, and the pipe system can also, for example, be situated within the auxiliary unit, in particular within the space spanned by the frame structure of the auxiliary unit. A condition for the device which is particularly space-saving is thereby provided for transport. The supporting structure can, for example, have greater height, length, and width dimensions than the nonwoven production device so that the nonwoven production device in a transport state can be surrounded by the supporting structure. For disposing the nonwoven production device in the supporting structure, remodeling or disassembling the nonwoven production device from the assembled state to the transport state, and vice versa, cannot be required. The nonwoven production device in the arrangement formed in the assembled state can in particular be moved or inserted into the supporting structure. Individual struts or carriers of the supporting structure can be removed therefor. The frame structure of the auxiliary unit can, for example, also have a greater height than the nonwoven production device and/or the liquid tank.

In a transport state, the nonwoven production device having its supporting structure and the auxiliary unit can, for example, be configured so that they are respectively able to be situated in a respective one transport container. A particularly advantageous transport of pre-installed components can thereby be carried out and the complexity for the final assembly can be reduced. The nonwoven production device including its supporting structure and the auxiliary unit including the frame structure can in particular be moved into one transport container, respectively, such as a 20" or 40" container, and be transported therein. The modular components of the device, for example, the nonwoven production device, the liquid tank, and the pipe system, are thereby respectively completely pre-assembled by the manufacturer, can be inserted into a transport container by the respective support or frame structure, can be transported with the aid of the transport container to a client, can be removed at the client from the transport container and can, for establishing the assembled state, be assembled into a complete system in a quick and relatively simple manner.

The method according to the present invention for assembling the device provides the following steps: removing the pre-assembled nonwoven production device by its supporting structure from a first transport container, removing the auxiliary unit from a second container, releasing the nonwoven production device from at least a portion of the supporting structure and positioning the nonwoven production device at a top side of the supporting structure, and establishing a fluidic connection between the nonwoven production device and the auxiliary unit, in particular by the fluid tank included therein.

Before establishing a fluidic connection, a positioning of the auxiliary unit adjacent to the supporting structure, and optionally a mechanical connection of the auxiliary unit, can, for example, be carried out. A secure stability is thereby in particular achieved.

For establishing a fluidic connection, at least one of the pre-installed pipes can, for example, be removed from the supporting structure or from the auxiliary unit and at least one of the pipes can, for example, be connected to the nonwoven production device, the liquid tank and/or the headbox pump. All components can in particular already be pre-installed so that they only need to be connected to each other, thereby providing the possibility of a particularly quick setup.

An exemplary embodiment of the present invention is explained in greater detail below based on the drawings.

Figure 2:
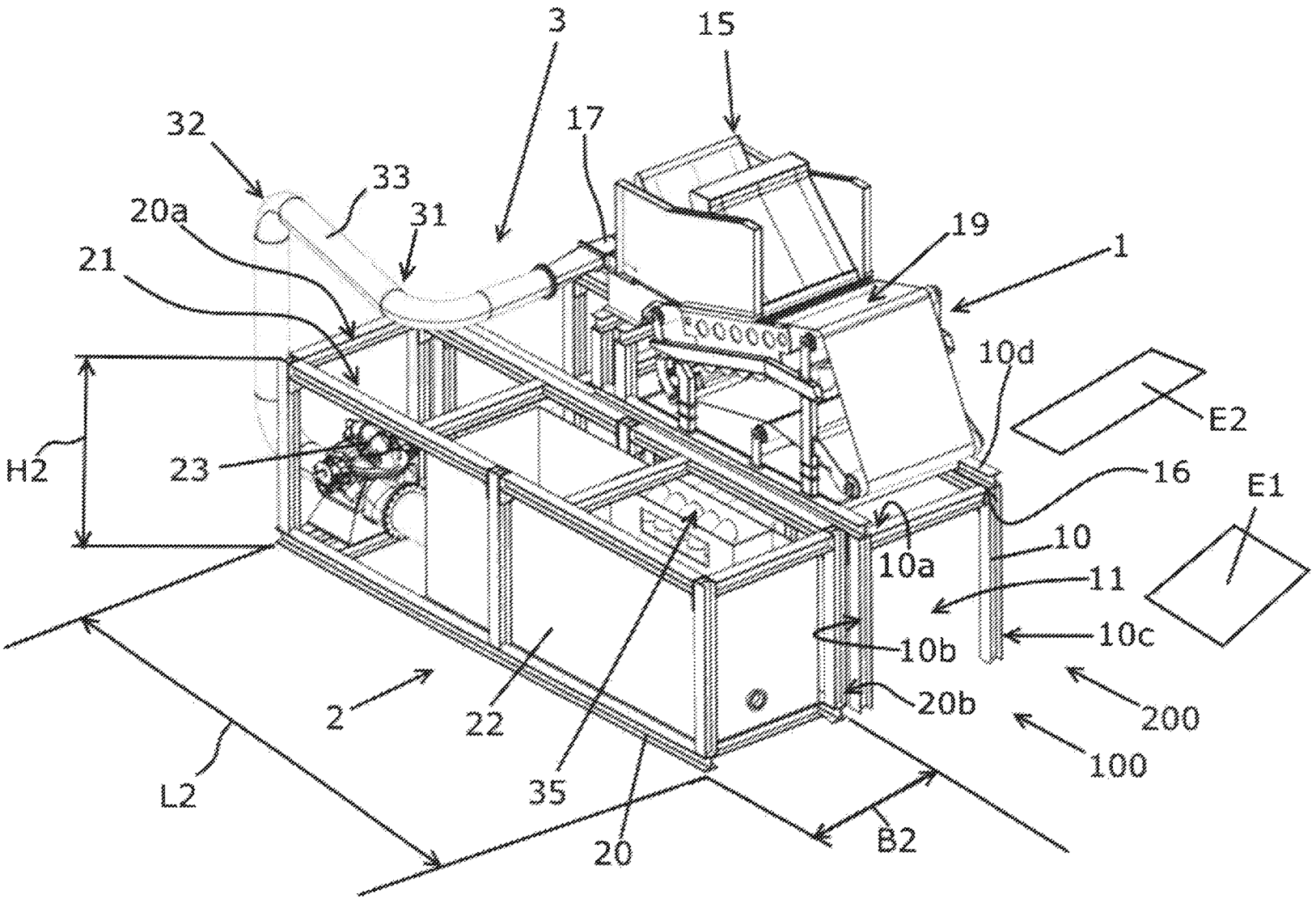
FIG. 2 shows the device according to the present invention in a different perspective view.
Figure 3:
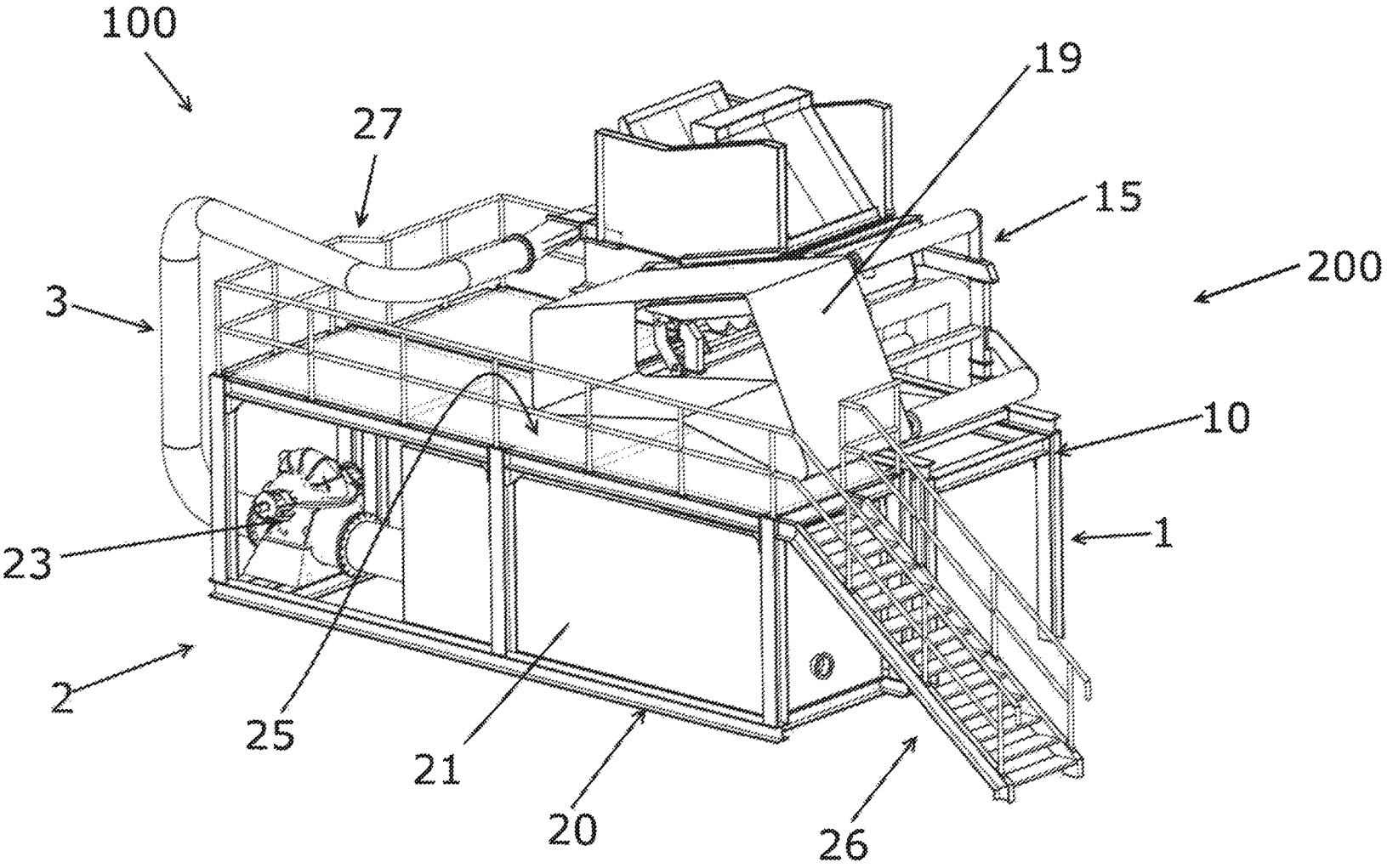
FIG. 3 shows the device according to FIG. 2 when exchanging a screen belt.

FIGS. 1-3 show two different respective perspective views of one device 100 for the production of nonwoven fabric webs in an assembled state 200. Device 100 is presently formed by a first system module 1, the so-called production unit, and a second system module 2, the so-called auxiliary unit, the two system modules 1 and 2 in the shown assembled state 200 being connected to each other by at least one pipe system 3. The assembled state 200 is presently to be understood as a state suitable for operating device 100.

Figure 4:
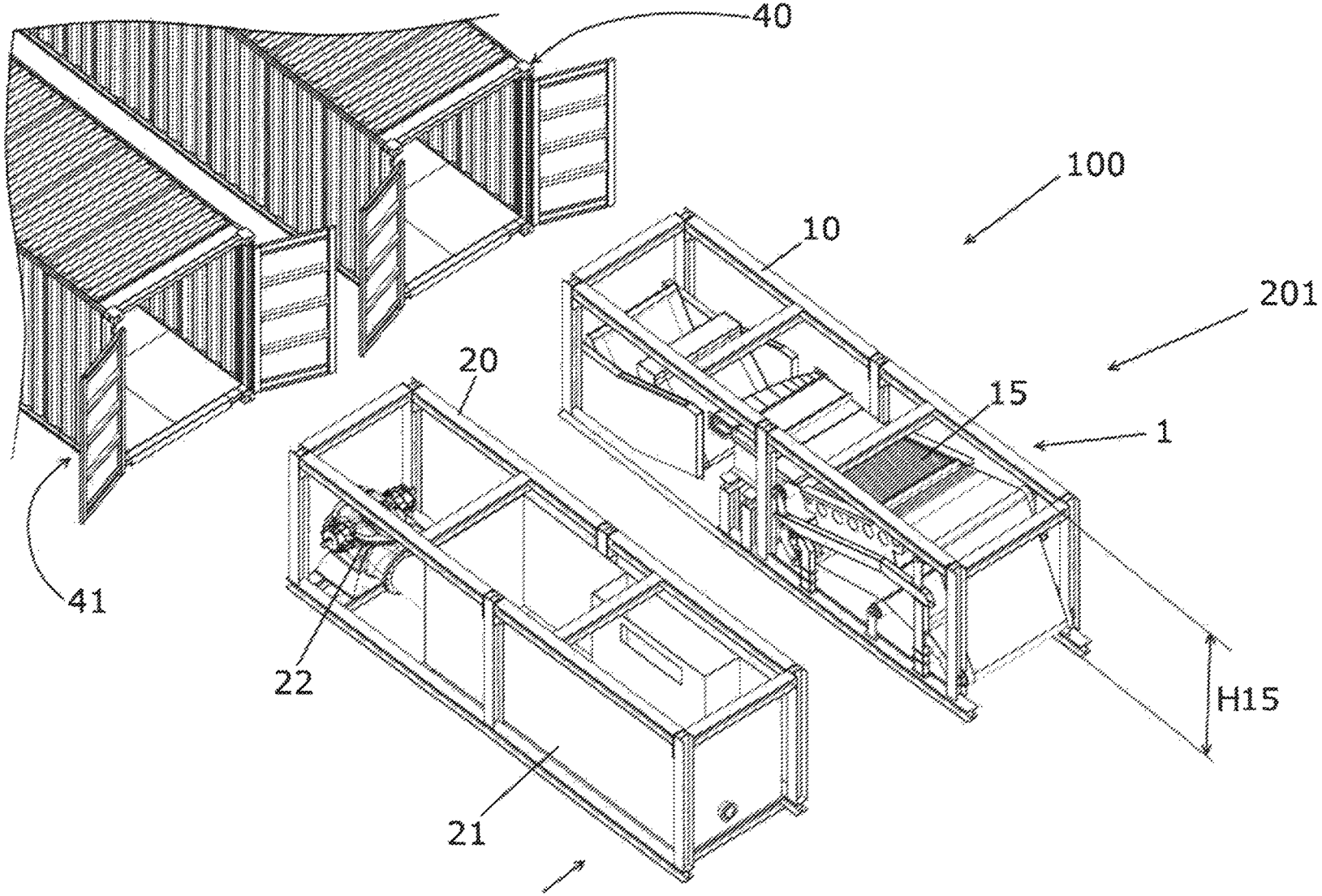
FIG. 4 shows the device in a transport state in a perspective view.

Production unit 1 includes a nonwoven production device 15 and a supporting structure 10, on which nonwoven production device 15 is situated. Auxiliary unit 2 includes a liquid tank 22, a headbox pump 23, and a frame structure 20 which surrounds the fluid tank 22 and the headbox pump 23. Pipe system 3, in particular connecting nonwoven production device 15 and liquid tank 22, can in principal be seen as part of auxiliary unit 2. Pipe system 3 in a transport state 201 of device 100, as shown in FIG. 4, can in principal be mounted within a space 21 surrounded by frame structure 20 of auxiliary unit 2. Transport state 201 is to be understood as a state suitable for transporting device 100.

Nonwoven production device 15, which is also called a treatment unit or fiber fleece machine, in particular for the production of wetlaid nonwovens or for carrying out a wetlaying method known per se, can be part of a production or manufacturing line including a plurality of sections (not shown in the embodiment), and can in particular can be integrated in such a production line. The production line can, for example, include one section for drying, calendering, and/or winding up the nonwoven fabric and, in the present case, typically extends in a common manner in the direction of the longitudinal extension of supporting structure 10 shown in the embodiment. The position or arrangement of a machine located in the production line, such as nonwoven production device 15 or complete production unit 1 in the present embodiment, is often referred to as the "driving side" of device 100, whereas a position adjacent to nonwoven production device 15, in particular the position of auxiliary unit 2 in the present embodiment, is often also referred to as the "operator side."

Nonwoven production device 15 is configured as a fiber fleece production machine known per se, having a manifold flow spreader 17, a headbox 18, and an inclined screen or endless screen belt 19. When operating nonwoven production device 15, nonwoven production device 15, in particular manifold flow spreader 17, is supplied with a mixture of a liquid, in particular water, and nonwoven fibers included therein, which then in the area of headbox 18 and inclined screen 19 are shaped into continuous nonwoven fabric webs by discharging the liquid in a targeted manner.

Liquid tank 22 provides the liquid required for production. Liquid tank 22 in particular includes water, also called white water, and is formed as a reservoir or storage container integrated in frame structure 20. Liquid tank 22 has a plurality of fluidic connectors for connecting pipe system 3. The fluid connectors can, for example, also be situated at side walls of frame structure 20 (not shown in the present embodiment), and in particular create a connection from space 21 to the surroundings or to a pipe section connecting within the surroundings. In a top area of liquid tank 22, a compressed-air buffer can be configured above the liquid level, which compressed-air buffer can have a pulsation absorbing effect to reduce pump strokes occurring in the system.

Headbox pump 23 is also situated in a space 21 spanned by frame structure 20 adjacent to liquid tank 22, in particular on a floor of frame structure 20. Headbox pump 23 serves to continuously feed transporting liquid from liquid pump 22 into nonwoven production device 15. In this instance, a first part of the liquid can be derived from liquid tank 22, and a second part of the liquid can be derived from a supply-side liquid cycle 32 formed by pipe system 3.

In the shown embodiment, pipe system 3 includes a supply line part 31 including liquid cycle 32, and a discharge line part 35. Supply line part 31 in particular serves to supply the liquid from liquid tank 22 to nonwoven production device 15, and discharge line part 35 in particular serves to discharge the liquid from nonwoven production device 15 to liquid tank 22. In the present case, supply-side liquid cycle 32 assigned to the supply line part 31 includes a first pipe section 33 situated between an outlet of headbox pump 23 and an inlet of manifold flow spreader 17, and a second pipe section 34 disposed as return flow pipe between an outlet of manifold flow spreader 17 and an inlet of headbox pump 23. Discharge line part 35 includes a plurality of, in the present case five, pipes 35*a*, 35*b*, 35*c*, 35*d*, 35*e* situated substantially parallel to one another, which are respectively situated between an outlet of nonwoven production device 15 disposed approximately below inclined screen 19 and an inlet of liquid tank 22. Supply line part 31 and discharge line part 35 thus form, together with liquid tank 22 and headbox pump 23, a further liquid cycle, the main liquid cycle.

In the shown embodiment, supporting structure 10 is formed by substantially vertically disposed stilts and horizontally disposed longitudinal and transverse carriers and by a structure spanning a space 11. Side walls, a floor and/or a ceiling for delimiting space 11 vis-à-vis the surroundings can be situated between the stilts and carriers (which are not shown in FIGS. 1, 2, and 4 to provide a better overview). Supporting structure 10 is, for example, produced from steel and is therefore relatively dimensionally stable. In the shown embodiment, supporting structure 10, for example, has a length L1 of approximately 12 meters, a height H1 of approximately 2.30 meters, and a width B1 of approximately 2.3 meters. In assembled state 200 shown in FIGS. 1 and 2, nonwoven production device 15 is arranged at top side 10*a* or on top of supporting structure 10. Supporting structure 10 in assembled state 200 thus serves as a base of nonwoven production device 15, in particular to prop up or to elevate the assembly of nonwoven production device 15 vis-à-vis the ground. In the shown embodiment, nonwoven production device 15 in assembled state 200, for example, has a length L15 of approximately 5.15 m, a width B15 of approximately 2.05 m, and, measured up to the top of screen belt deflector roller, a height H15 of approximately 2.2 m. The total height of nonwoven production device 15 is, for example, approximately 3.2 m. In transport state 201 shown in FIG. 4, nonwoven production device 15 is situated in space 11 spanned by supporting structure 10 in a, for example, fully or partially assembled state, i.e., it is only rebuilt but not completely disassembled. Nonwoven production device 15 in transport state 201 therefore has a slightly smaller overall size than supporting structure 10, for example, a length of approximately 11 m, a width of approximately 2 m, and a height of approximately 2.2 m. It is also possible that nonwoven production device 15, in order to be able to be moved to transport state 201 surrounding supporting structure 10, has smaller dimensions only in the area of the struts and supports of supporting structure 10 than supporting structure 10. In this instance, nonwoven production device 15 can at least partially surround in particular the struts and supports at two longitudinal sides.

Frame structure 20 of auxiliary unit 2 is constructed substantially identical to supporting structure 10 and in particular includes stilts, longitudinal and transverse carriers, as well as an identical length L2, width B2, and height H2. The frame structure can also include side walls, a floor, and/or a ceiling, which, for providing a better overview, are shown in FIGS. 1 and 3, but are in contrast not shown in FIGS. 2 and 4. Auxiliary unit 20 can, for example, have a length L2 of approximately 12 meters, a height H2 of approximately 2.30 meters, and a width B2 of approximately 2.3 meters. In assembled state 200, liquid tank 22 and headbox pump 23 are situated within space 21 surrounded by the stilts and the carriers. In transport state 201, pipe system 3 can additionally, for example, be disassembled into individual components and/or component groups, and in particular can be situated in a stored manner in liquid tank 22 typically empty in transport state 201, such is shown in FIG. 4.

In assembled state 200 shown in FIGS. 1-3, supporting structure 10 and frame structure 20 are positioned directly next to each other, and are in particular substantially parallel in the longitudinal extension of supporting structure 10 and frame structure 20. Supporting structure 10 by a longitudinal side surface 10*b* facing auxiliary unit 2 thus abuts with or without contact at a longitudinal side surface 20*b* of frame structure 20 facing supporting structure 10. For increasing stability, supporting structure 10 and frame structure 20 can be mechanically connected to each other, for example, at touching corners, via a coupling device (which is not shown in greater detail).

Nonwoven production device 15 situated on top side 10*a* of supporting structure 10, in the present case, has two pedestals or stand rails formed by two carriers or struts 10*d*. These carriers 10*d* can be part of supporting structure 10, in particular in the bottom area of supporting structure 10, and can be released from supporting structure 10 for storing nonwoven production device 15.

A platform 25 is configured at a ceiling or top side 20*a* of frame structure 20 (which is shown in FIG. 1 only as dashes to provide a better overview, while the entire face is shown in FIG. 3). In the simplest form, platform 25 can be formed by a ceiling of frame structure 20, in particular by a continuous or holohedral platform bottom, as shown in FIG. 3. The platform 25 serves in particular as a scaffold or work platform for nonwoven production device 15 and accordingly is configured as walkable. Platform 25 can in particular be accessed by one or a plurality of persons. For this purpose, auxiliary unit 2 or frame structure 20 advantageously have support or safety devices, in the present case, for example, a staircase 26, a ladder, and/or a safety barrier, in the present case, for example, a guardrail 27. In the shown embodiment, guardrail 27 can extend up to the area above supporting structure 10, as can be seen in FIG. 3. By positioning platform 25 at top side 20*a* of auxiliary unit 20, in assembled state 200, access to nonwoven production device 15 and/or pipe system 3, for example, for assembly, operation, service, and the like, can be enabled in a particularly suitable and advantageous manner. At the same time, nonwoven production device 15 and liquid tank 22, both being supported via respective supporting structure 10 and frame structure 20, can be situated on the same floor level, in particular a plane E1, as a result of which an additional floor provided on the side of the building or the guardrail is not necessary.

It may be provided that, for example, for assembly, operation, service or a complete exchange of nonwoven production device 15, at least one part or component group of nonwoven production device 15 is sideways moveable from a position above supporting structure 10 in the direction of platform 25, as it is shown in FIG. 3. In particular, a rack supporting screen belt 19, which is not shown in FIG. 3 and which in principle can be configured as a part of or separately from nonwoven production device 15, is situated on platform 25 adjacent to nonwoven production device 15. As a result, in the case of a screen belt exchange, screen belt 19 by a lateral movement can be installed or pre-installed in a particularly easy manner from or onto the deflection roller of nonwoven production device 15. It is also possible to move nonwoven production device 15 in total sideways from top side 10*a* of supporting structure 10 onto top side 20*a* of frame structure 20, and thus out of the production line. It is advantageous to situate top side 20*a* of frame structure 20 and bottom side 16 of nonwoven production device 15 in a common plane E2 for this purpose.

In order to prevent access to nonwoven production device 15 from being negatively impacted, discharge pipes 35*a*, 35*b*, 35*c*, 35*d*, 35*e* are situated on a side 10*c* of supporting structure 10 opposite auxiliary unit 2 and are substantially designed in a C-shaped manner. In particular, pipes 35*a*, 35*b*, 35*c*, 35*d*, 35*e* by a top area are guided out of nonwoven production device 15 at a side of nonwoven production device 15 opposite of auxiliary unit 2 and then extend downward by forming one or a plurality of curves and, in a bottom area of the C-shape, are guided at longitudinal side 10*c* into, and subsequently through, space 11 of supporting structure 10 situated below nonwoven production device 15 to longitudinal side 10*b* facing auxiliary unit 2 and, finally, into space 21 of auxiliary unit 2 spanned by frame structure 20 up to an inlet of liquid tank 22. First pipe section 33 of liquid cycle 32 serving as supply line part 31 is also guided sideways, in particular at an end face, out of frame structure 20 and then extends in one or a plurality of curves upward up to above auxiliary unit 2 or platform 25 and up to the inlet of manifold flow spreader 17. This arrangement provides that first pipe section 33 running into manifold flow spreader 17 is accessible by a person standing on platform 25, for example, for controlling the fiber mixture, for manually supplying fibers, or upwardly connecting a central or rotary distributor. Second pipe section 34 of liquid cycle 32 serving as a return flow pipe extends downward from an outlet of manifold flow spreader 17 situated again on a side facing away from auxiliary unit 2, in one or a plurality of curves and through space 11 up to space 21 and therein up to headbox pump 23.

In transport state 201 of device 100 shown in FIG. 4, components provided for the production of nonwoven fabric webs, such as nonwoven production device 15, liquid tank 22, headbox pump 23, and pipe system 3, are stored within supporting structure 10 and frame structure 20. In particular, nonwoven production device 15, the supporting stand rail 10*d* of which is situated as a floor beam or bottom side of supporting structure 10, and pipes 35*a*, 35*b*, 35*c*, 35*d*, 35*e* of discharge line part 35 are situated within supporting structure 10, and together with the supporting structure form first system module 1. Pipe system 3 and platform 25 are not shown in FIG. 4 in order to provide a better overview. Liquid tank 22, headbox pump 23, and first and second pipe sections 33, 34 of supply-side liquid cycle 32 are situated within frame structure 20 and form together with this frame structure second system module 2.

For transporting, it is provided to insert first system module 1 in the assembly shown in FIG. 4 into a first transport container 40, and second system module 2 into a second transport container 41. Transport containers 40, 41 are in particular respectively configured as standardized, so-called 40-foot containers. As a result, first and second system modules 1, 2 can be inserted into respective transport container 40, 41 being nearly fully assembled and can be transported therein to their site of operation. At the site of operation, it is provided to remove first and second system modules 1, 2 from transport containers 40, 41 and to then assemble, in particular by situating supporting structure 10 and frame structure 20 adjacently and nonwoven production device 15 on top side 10*a* of supporting structure 10. Transport containers 40, 41 in the empty state, for example, can then be re-transported to the manufacturer.

It also should be made clear that the scope of protection of the present invention is not limited to the described exemplary embodiments. The construction of the supporting and frame structures and the positioning of the pipe system can in particular be modified without leaving the scope of the present invention. Reference should also be had to the appended claims.

LIST OF REFERENCE NUMERALS

1 first system module, production unit
2 second system module, auxiliary unit
3 pipe system
10 supporting structure
10*a* top side, ceiling
10*b* longitudinal side structure, longitudinal side wall
10*c* longitudinal side, longitudinal side wall
10*d* carrier, strut, stand rail, floor beam, bottom side
11 space
15 nonwoven production device
16 bottom side
17 manifold flow spreader
18 headbox
19 screen belt, inclined screen
20 frame structure
20*a* top side, ceiling
20*b* longitudinal side structure, longitudinal side wall
21 space
22 liquid tank, white water tank
23 headbox pump
25 platform
26 staircase
27 guardrail
31 supply line part
32 liquid cycle
33 first pipe section
34 second pipe section
35 discharge line part

35*a* pipe, discharge line
35*b* pipe, discharge line
35*c* pipe, discharge line
35*d* pipe, discharge line
35*e* pipe, discharge line
40 transport container
41 transport container
100 device
200 assembled state
201 transport state
E1 plane
E2 plane
H1 height
H2 height
H15 height
B1 width
B2 width
B15 width
L1 length
L2 length
L15 length

What is claimed is:

1. A device for the production of nonwoven fabric webs, the device comprising:

a nonwoven production device comprising a supporting structure; and an auxiliary unit comprising at least one liquid tank and a platform arranged on a top side of the auxiliary unit, wherein, the nonwoven production device is arranged on the supporting structure in an assembled state, and the nonwoven production device and the auxiliary unit are arranged in relation to each other so that, for at least one of assembling, operating, and repairing the nonwoven production device, access to the nonwoven production device is provided from the platform.

2. The device as recited in claim 1, wherein, in the assembled state, the auxiliary unit is arranged directly or indirectly adjacent to the supporting structure.

3. The device as recited in claim 1, wherein, in the assembled state, the auxiliary unit and the supporting structure are arranged at a same geodetic height.

4. The device as recited in claim 1, wherein, in the assembled state, the top side of the auxiliary unit and a bottom side of the nonwoven production device are situated in one plane.

5. The device as recited in claim 1, wherein, in the assembled state, at least one part of the nonwoven production device is configured to be movable towards the auxiliary unit.

6. The device as recited in claim 5, wherein, in the assembled state, the at least one part of the non-woven production device is configured to be movable sideways towards the auxiliary unit above the auxiliary unit.

7. The device as recited in claim 1, wherein the supporting structure and the auxiliary unit are mechanically connectable to each other.

8. The device as recited in claim 1, wherein the auxiliary unit further comprises a frame structure which surrounds at least the liquid tank or which is at least partially formed by the liquid tank.

9. The device as recited in claim 1, further comprising:

at least one pipe system comprising at least one pipe, the at least one pipe system being at least one of guided into and through at least one of the supporting structure and the auxiliary unit on one side, wherein, in the assembled state, a fluidic connection is provided between the nonwoven production device and the liquid tank via the at least one pipe system.

10. The device as recited in claim 9, wherein, a pipe of the at least one pipe is provided as a discharge line of a liquid, a section of the discharge line being arranged below the nonwoven production device from a first side of the supporting structure, through the supporting structure, to a second side of the supporting structure.

11. The device as recited in claim 1, wherein, in a transport state, the nonwoven production device is surrounded by the supporting structure.

12. The device as recited in claim 1, wherein, in a transport state, the nonwoven production device comprising the supporting structure is configured to fit into a first transport container, and the auxiliary unit is configured to fit into a second transport container.

* * * * *